US005223818A

United States Patent [19]

Polo

[11] Patent Number: 5,223,818

[45] Date of Patent: Jun. 29, 1993

[54] CONCEALED REMOTE ALARM ACTIVATOR

[76] Inventor: Benito L. Polo, 9446 Borson St., Downey, Calif. 90242

[21] Appl. No.: 833,289

[22] Filed: Feb. 10, 1992

[51] Int. Cl.[5] ..... G08B 13/00

[52] U.S. Cl. ..... 340/574; 200/DIG. 2; 340/539; 341/176; 455/100

[58] Field of Search ..... 340/574, 539; 455/100; 341/176; 200/DIG. 2

[56] References Cited

U.S. PATENT DOCUMENTS

| | | | |
|---|---|---|---|
| Re. 29,525 | 1/1978 | Willmott | 341/176 |
| 3,914,692 | 10/1975 | Seaborn, Jr. | 340/539 |
| 4,157,540 | 6/1979 | Oros | 340/574 |
| 4,227,189 | 10/1990 | Davis | 340/574 |
| 4,300,129 | 11/1981 | Cataldo | 340/574 |

*Primary Examiner*—Glen R. Swann, III

*Attorney, Agent, or Firm*—Robbins, Dalgarn, Berliner & Carson

[57] ABSTRACT

A digital signal transmitter which is mounted upon a rigid panel by resiliently deformable strips such as double-sided adhesive or springs. The mounting is such that a button is disposed adjacent a switch contained within the transmitter structure. The entire apparatus is then worn by a person upon a belt-like structure in such a way that upon muscular expansion by the person wearing the structure, the button closes the switch causing the transmitter to emit a radio frequency signal. The radio frequency signal may then be received by a transponder or other electronic device which amplifies and converts the signal and directs it toward a central station.

10 Claims, 1 Drawing Sheet

CONCEALED REMOTE ALARM ACTIVATOR

BACKGROUND OF THE INVENTION

1. Field of the Invention

This invention relates generally to security alarm systems and more particularly to a concealed remote activator for use in conjunction with such systems.

2. Description of the Prior Art

Security in various settings has become increasingly a problem. All merchants are experiencing an increase in robberies and such is particularly noticeable in banks, convenience stores and other businesses particularly those providing service to the public during late night and early morning hours. Various attempts have been made to provide security particularly by providing alarms which may be activated by an attendant or clerk on duty at the business facility.

Many such alarm systems include a digital communication module which when activated transmits digital signals which may be enhanced by transponders and then transmitted either by radio signals or over a telephone line link to a central station, the police or other security personnel. To activate any of the presently known security alarm systems requires a positive movement by the person on duty to press a switch either by hand or foot. Obviously, such physical movement by such person is readily noticeable to the robber. When such movement occurs, the robber may, in retaliation, inflict physical harm upon the person.

SUMMARY OF THE INVENTION

The present invention is a concealed remote alarm activator which may be worn by a person such as a bank teller. The remote alarm activator includes a digital signal transmitter having a switch. The transmitter is mounted upon resiliently deformable means disposed between a rigid mounting surface and the transmitter. Upon application of a predetermined force, relative movement occurs between the transmitter and the surface to bring a protrusion into contact with and thereby to close said switch causing a digital signal to be transmitted.

In accordance with a more specific aspect of the present invention, the mounting surface carrying the resiliently mounted digital signal transmitter is disposed upon a belt-like means worn by an individual. When appropriate and sufficient muscular expansion occurs, such as by extending the abdomen, the required amount of force is transmitted in a concealed manner to cause the relative movement and switch activation to occur.

BRIEF DESCRIPTION OF THE DRAWINGS

The above and other features of the present invention may be more fully understood from the following detailed description, taken together with the accompanying drawings, wherein similar characters refer to similar elements throughout and in which.

DETAILED DESCRIPTION

Figure 1:
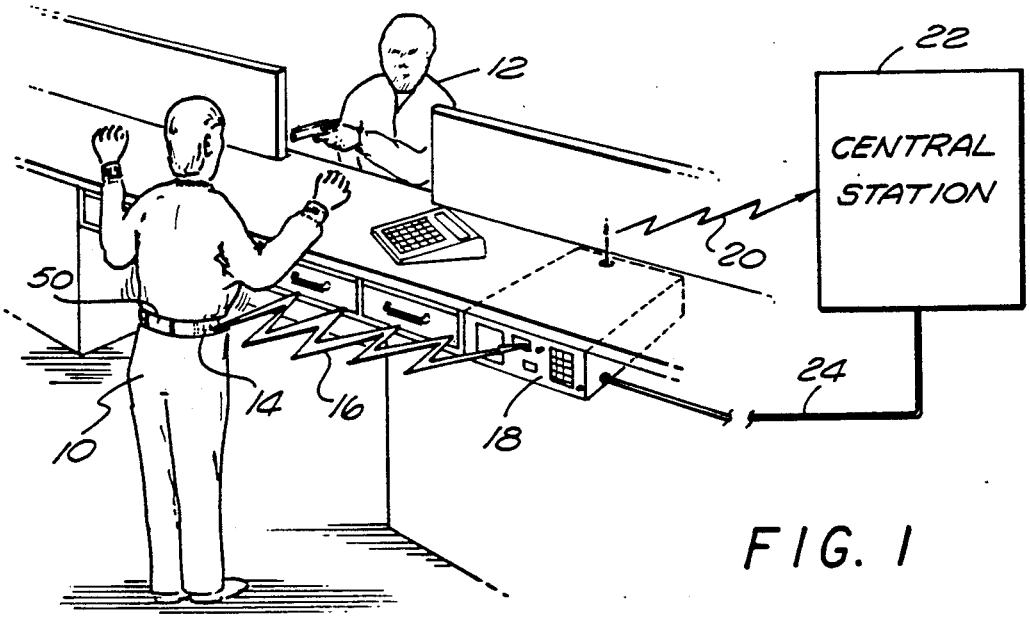
FIG. 1 is illustrative of a system utilizing the concealed remote alarm activator constructed in accordance with the present invention.

As is shown in FIG. 1, a clerk, teller or other service provider 10 in any type of facility may be accosted by a robber 12 or other such person intent upon taking money, goods or other materials from a place of business. The clerk 10 may be wearing a concealed remote alarm activator 14 constructed in accordance with the present invention. Upon being accosted by the robber 12, the clerk 10 need only expand his abdomen and thereby apply sufficient force to the remote activator 14 to cause it to transmit a digital signal as shown schematically at 16 to a transponder 18. The transponder 18 intercepts the signal 16, amplifies and converts it to the required signal format which may then be transmitted as a radio frequency signal as shown at 20 to a remote security position. The remote position may be a central station 22 such as a central security station, a police station, a security vehicle or the like. Alternatively, the transponder 18 may be coupled by a telephone link 24 with the central station 22. In either event, a silent signal is transmitted by the activator 14 which is then received, amplified and converted as may be required, and as is well known to those skilled in the art, by the transponder to create an alarm at an appropriate security position be it a central station, a roving security vehicle or the like. In either event, the clerk or teller 10 will then receive rapid assistance.

As will be noted by those skilled in the art, no noticeable physical movement is required by the clerk 10 to actuate the remote alarm activator 14. That is, the clerk 10 does not need to move his hands, his feet or any other portion of his body for the purpose of pushing on a button or moving a switch to activate the alarm. All that is required is muscular expansion such as movement of the abdomen. Throughout the remainder of this specification, such muscular expansion will be described in connection with expansion of the abdomen. It should, however, be expressly understood that the muscular expansion may occur with regard to other portions of the body such as arms, legs, or the like wherein sufficient, but not readily noticeable, muscular expansion can occur to a degree sufficient to close a switch on the remote alarm activator 14 as will be described more fully below.

Figure 2:
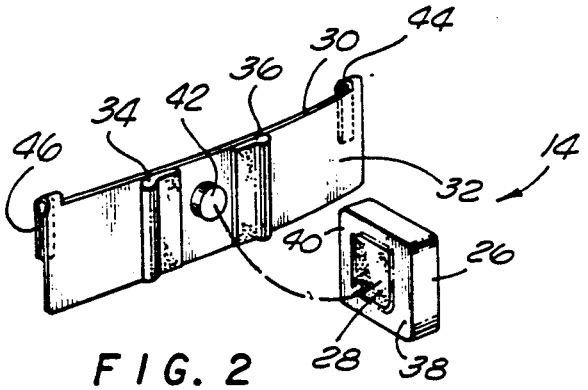
FIG. 2 is a perspective view, partially exploded, showing one embodiment of a concealed remote alarm activator constructed in accordance with the present invention.

As illustrated in FIG. 2, the concealed remote alarm activator constructed in accordance with the present invention includes a digital signal transmitter 26 including a switch 28. Such transmitters are well known in the art and may be readily purchased by those desiring the same. One such digital communication module is manufactured by Alarm Electronics of Taylorsville, North Carolina, Model No. WW-101. Any of the known devices of this type may be used as part of the concealed remote alarm activator constructed in accordance with the present invention. The transmitter 26 is carried by a rigid mounting means such as a plate 30 having a surface 32. Resiliently deformable means such as rubber-like strips 34 and 36 are secured to the surface 32 and are, in turn, designed to receive the side edges 38 and 40 of the transmitter 26. The strips 24 and 36 may be double-sided adhesive strips constructed from compressible polyurethane foam or similar plastic materials. A protrusion such as a rigid button 42 is affixed to the surface 32 and disposed adjacent the switch 28 when the transmitter 26 is secured to the strips 34 and 36. The rigid mounting means also includes means such as a pair of hooks 42 and 44 for securing the remote alarm activator 14 to a person. Although the means for securing are shown as bent over tabs 42 and 44 (which may be bent in either direction with respect to the rigid plate 30), any type of attaching or securing means may be utilized.

Figure 3:
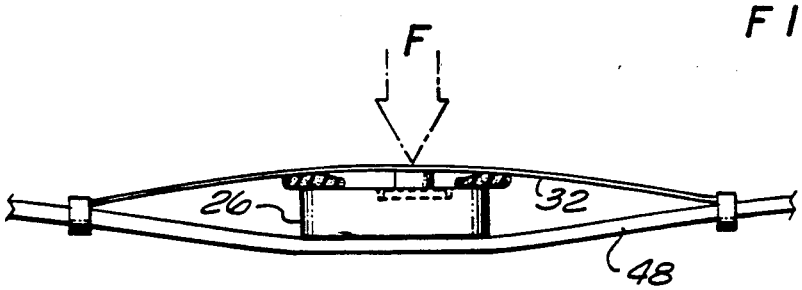
FIG. 3 is a plan view showing the structure of FIG. 2 in assembled format.

As is shown in FIG. 3, the digital signal transmitter 26 is effectively sandwiched between a belt-like member 48 and the inner surface 32 of the rigid mounting plate 30. The belt-like member 48 may be a typical belt 50 which is worn by the person 10 about his mid-section in precisely the same manner as any belt. In this way, the remote alarm activator 14 is readily hidden from view and would not be seen by the robber 12. Assuming that the belt-like means 48 is, in fact, a belt as is shown at 50 in FIG. 1, then when the abdomen of the person 10 is expanded by muscular expansion, a force F is generated causing relative movement between the transmitter 26 and the surface 32 thereby causing the button 42 to move toward the switch 28 closing the same. Upon closure of the switch 28, the signal as illustrated at 16 is transmitted to the transponder 18 or other receiving device as above generally described.

Figure 4:
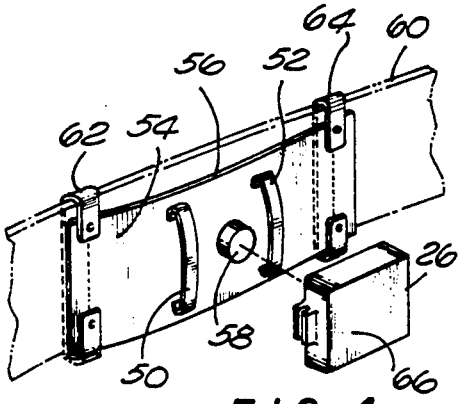
FIG. 4 is a view similar to FIG. 2 illustrative of an alternative embodiment of a concealed remote alarm activator constructed in accordance with the principals of the present invention.

By reference now more specifically to FIG. 4, the resiliently deformable mounting means for the transmitter 26 is illustrated as a pair of springs 50–52 which may be affixed to the surface 54 of the rigid plate 56 in any manner desired such as by spot welding, riveting or the like. Means is provided for affixing the transmitter 26 to the springs 50–52 in a removable fashion. Any means desired may be used such as an adhesive, a clip or the like so that the switch 28 is disposed adjacent the button 58 for activation as abovedescribed.

It should be expressly understood that the resiliently deformable means, such as the strips 34-36 or the springs 50-52, must be designed in such a way that the switch 28 will be activated only upon the application of the predetermined amount of force as above discussed. The switch 28 must not be closed as a result of normal movement of the person 10. That is, normal breathing, a person bending over to tie a shoelace, rapidly walking resulting in heavier and deeper breathing, or the like, then the predetermined force required to activate the transmitter will not occur. However, when the person 10 upon being accosted by the robber 12 intentionally expands the muscles in his abdomen by urging the same outward, the desired amount of force F is generated causing the resiliently deformable means to be compressed by an amount sufficient to cause the button 42 or 58 to close the switch 28 initiating transmission of the digital signals to the transponder.

As is shown in FIG. 4, the means for securing the plate 56 to the belt-like member 60 includes a pair of loops 62–64 through which the belt-like member 60 may be threaded. The loops 62–64 may be on either side of the member 56 and the belt-like member 60 may also be disposed adjacent the member 56 as shown as well as over the transmitter 26 as shown in FIG. 3. In some instances, if the belt is disposed as shown in FIG. 4, an additional rigid plate or member may be disposed adjacent the surface 66 of the transmitter 26 to assist in applying force sufficient to accomplish relative movement between the transmitter 26 and the surface 54 to close the switch 28.

Various other structures and configurations of a concealed remote alarm activator may be constructed without departing from the scope of the invention as defined in the claims appended hereto.

What is claimed:

1. Concealed remote alarm activator comprising:

a digital signal transmitter including a switch;

rigid mounting means including a first surface for carrying said transmitter;

resiliently deformable means affixed to said first surface;

means for mounting said transmitter to said resiliently deformable means so that upon application of force relative movement will occur between said transmitter and said surface urging said transmitter toward said surface; and means disposed between said surface and said switch for closing said switch upon application of a predetermined amount of said force.

2. Concealed remote alarm activator as defined in claim 1 which further includes attachment means on said mounting means for securing said activator to a person.

3. Concealed remote alarm activator as defined in claim 2 wherein said attachment means includes means for securing said activator on a beltlike means worn by said person so that upon muscular expansion by the person said predetermined force is applied.

4. Concealed remote alarm activator as defined in claim 3 wherein said transmitter is sandwiched between said belt-like means and said mounting means when being worn by said person.

5. Concealed remote alarm activator as defined in claim 4 wherein said means for securing includes a pair of hooks carried by said mounting means.

6. Concealed remote alarm activator as defined in claim 4 wherein said means for securing includes a pair of loops carried by said mounting means.

7. Concealed remote alarm activator as defined in claim 2 wherein said means for closing said switch includes a protrusion extending from said surface and disposed adjacent said switch.

8. Concealed remote alarm activator as defined in claim 2 wherein said resiliently deformable means includes a rubber-like member.

9. Concealed remote alarm activator as defined in claim 8 wherein said means for mounting said transmitter to said resiliently deformable means includes an adhesive.

10. Concealed remote alarm activator as defined in claim 2 wherein said resiliently deformable means includes spring means.

* * * * *